United States Patent [19]

Babsch

[11] Patent Number: 4,725,154

[45] Date of Patent: Feb. 16, 1988

[54] THERMO TRANSFER DOT PRINTING

[75] Inventor: Alfred Babsch, Ulm-Soeflingen, Fed. Rep. of Germany

[73] Assignee: Mannesmann AG, Duesseldorf, Fed. Rep. of Germany

[21] Appl. No.: 882,494

[22] Filed: Jul. 7, 1986

[30] Foreign Application Priority Data

Jul. 5, 1985 [DE] Fed. Rep. of Germany ..... 3524031

[51] Int. Cl.[4] ..... B41J 3/12

[52] U.S. Cl. ..... 400/120; 346/76 PH; 219/216

[58] Field of Search ..... 400/120, 121; 219/216; 346/76 PH; 101/93.04

[56] References Cited

U.S. PATENT DOCUMENTS

| | | | |
|---|---|---|---|
| 2,715,360 | 8/1955 | Brown, Jr. | 400/121 |
| 3,312,979 | 4/1987 | Torre et al. | 400/120 |
| 3,409,902 | 11/1968 | Merryman | 101/92 |
| 4,266,115 | 5/1981 | Dannatt | 219/216 |
| 4,462,035 | 7/1984 | Koto | 346/76 PH |
| 4,514,736 | 4/1985 | Moriguchi et al. | 346/76 PH |
| 4,549,189 | 10/1985 | Shiratsuki | 346/76 PH |
| 4,561,789 | 12/1985 | Saito | 400/120 |

FOREIGN PATENT DOCUMENTS

| | | | |
|---|---|---|---|
| 2349234 | of 1974 | Fed. Rep. of Germany | 400/120 |
| 2758280 | 10/1978 | Fed. Rep. of Germany | 400/120 |
| 0028873 | 3/1981 | Japan | 400/120 |
| 0127779 | 7/1984 | Japan | 400/120 |
| 0000971 | 1/1985 | Japan | 400/120 |
| 0019558 | 1/1985 | Japan | 400/120 |

OTHER PUBLICATIONS

IBM Technical Disclosure Bulletin, vol. 27, No. 12, May 1985.

*Primary Examiner*—Edgar S. Burr
*Assistant Examiner*—Huong Q. Pham
*Attorney, Agent, or Firm*—Ralf H. Siegemund

[57] ABSTRACT

A thermo transfer matrix printer has a print drum having over its entire periphery a first set of equidistantly spaced axially extending electrode lines, further having a second set of azimuthally extending electrode lines; the two sets of lines are separated through an electrical resistance layer such that an electrode line of the first set intersecting a line of the second set but being separated therefrom by the resistant layer is resistively interconnected at that intersection, thereby establishing a heatable matrix point; an ink dispensing station is disposed along the periphery of said drum for transferring over the entire length of the drum thermo ink and dyw to adhere to the outer periphery of the drum at heated points; and a platen drum is disposed adjacent to the transfer drum for urging a print medium against the transfer drum is a tangential line of printing.

3 Claims, 4 Drawing Figures

Fig. 1
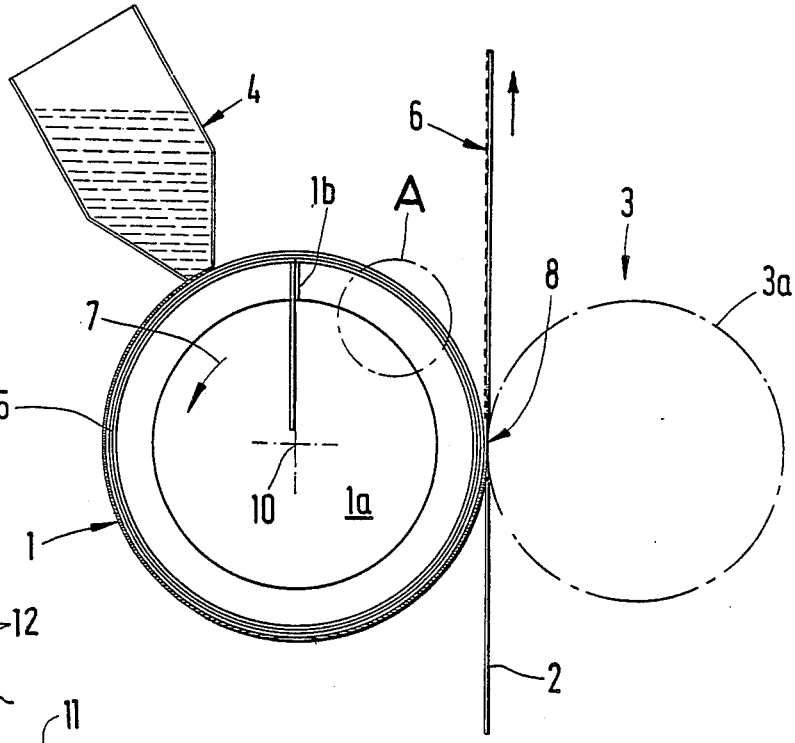
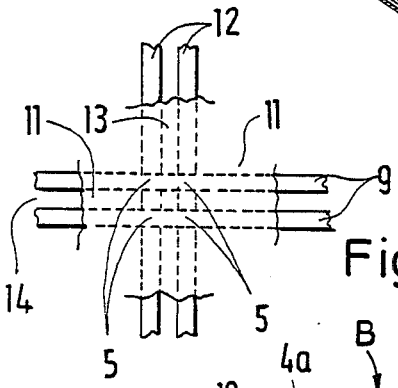
Fig. 2a
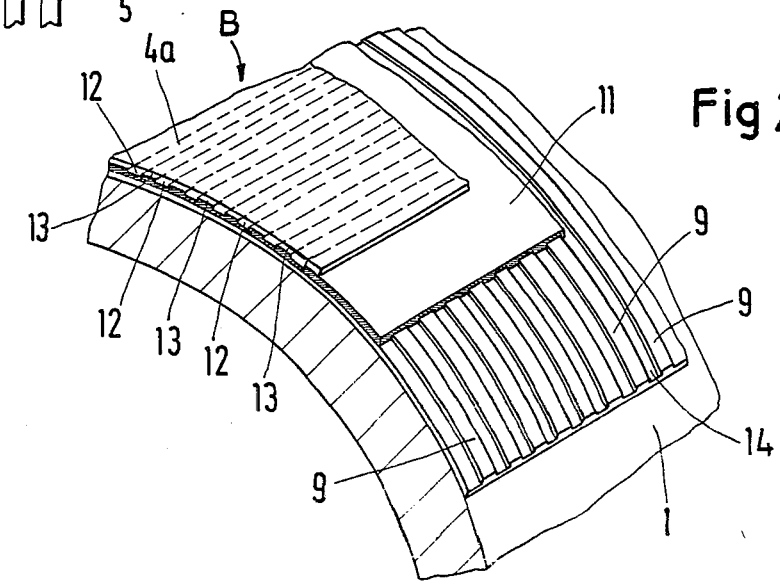
Fig 2

THERMO TRANSFER DOT PRINTING

BACKGROUND OF THE INVENTION

The present invention relates to thermo transfer type matrix printer for line-for-line printing and composing individual characters from dots by means of and in accordance with the thermo-transfer principle; the printer is to include a cylindrical printing drum, having a length which at least approximates the length of a line to be printed, and having a surface composed of heatable matrix "points" which can be controlled serially as well as in parallel as for groups of points sequentially .

Thermo printers in the most general sense to which the invention pertains can be classified as follows. In one instance thermo printing is obtained by means of thermo sensitive paper under utilization of a heatable printing head and through heating of selected spots of the paper so that the heated spot will discolor and assumes a contrasting appearance. A second type also called thermo transfer printing a wax layer containing a dye or ink is molten through a carrier foil under utilization of a heatable printing element and that part is then transferred upon regular paper. A third version is called an electro transfer printing process wherein an ink ribbon is used for carrying a wax layer with a dye or ink, the ribbon includes also a carrier foil, a metallic, i.e. electrically conductive layer, and a resistance layer with low electrical conductivity. By means of slide contacts the resistance layer receives current and is thus heated and the dye-wax layer is molten. The electricl conductive layer serves as general electrical return path.

The electro transfer method is disadvantaged by the fact that one needs a ribbon of particular and special construction. The used-up spots of a thermo ink ribbon are not subject to regeneration so that the use of such kind of ribbons becomes very expensive.

A so-called thermo transfer matrix printer is known, for example, through German Pat. No. 1,549,911. A printing device is proposed using only a very small number of slip rings. These slip rings are provided to transfer digital data including print data clocking signals, gate control, gate clocking etc. to a rotating device (drum) with a periphery being comprised of individual semiconductor/heating elements. These elements are selectively heated. Heat sensitive paper is run over the drum in order to benefit from a looping angle of at least 180 degrees. In this case then one does need a special kind of paper.

DESCRIPTION OF THE INVENTION

It is an object of the present invention to provide a new and improved thermo transfer matrix printing process and apparatus which permits utilization of regular paper while avoiding the utilization of a particular ink or dye ribbon.

In accordance with the preferred embodiment of the present invention, it is suggested to provide a printing drum being synchronously rotated with a platen roller and a sheet of regular paper abuts the platen and the printing drum such that in particular positions along a line of contact dots are printed in that a thermo color dye or ink dots are transferred upon the regular paper. The ink or dye, in turn, is tangentially transmitted selectively from an ink dispensed downstream from the print line and onto heated dots on the drum. The characters are composed of dots in a dot-by-dot pattern as far as print lines are concerned and pursuant to continuous movement of the paper through the print line.

This method and equipment does not require an ink ribbon nor special paper. The high resolution of the drum's periphery obtains through its subdivision into many small, closely spaced matrix points. In the direction of the rotation of the printing and transfer drum and downstream from the print line, thermally effective dye or ink is transferred just upon those matrix points which were depleted from their ink upon passing through the print line. The restoration of a thermo dye or thermally effective ink is carried out by reheating of those matrix points which have been used for purposes of printing. These points are selectively controllable anew for each cycle of rotation of the printing drum. The selection of "used-up" points can preferably be stored separately in appropriate memory facilities so as to retain a memory of these points which have been used for printing, to be subsequently reactivated for receiving again ink.

The thermo transfer matrix printer in accordance with the invention is particularly characterized by a thermo or thermal ink transfer drum being positioned opposite a platen drum, the paper being sandwiched in-between. This transfer drum is, so to speak, covered by a network of matrix points which can be heated electrically by brief pulses and a thermally active dye or ink transfer station is arranged along the periphery of that drum which contacts a portion of the periphery of the network of matrix points for purposes of ink transfer onto the drum. The ink transfer device as per the invention is almost completely free from maintenance requirements because at all times the matrix point network is covered with dye or ink and they, in fact, shield the heatable matrix points against external interference. The inventive principle is not just applicable to black and white printing, but also for multi color printing and will provide a corresponding number of ink or dye depositing stations along the periphery of the transfer drum.

As compared with German Pat. No. 15 49 911, showing a particular system of print element groups composed of thermally effected print heads each constituting plural matrix points, and these points are configured as a semiconductive elemental areas covered with silicon-carbide. The inventive system is considerably simpler. The improvement provided by the present invention establishes at the network of matrix points that is, so to speak, indirectly established on the cylindrical periphery of the transfer drum through spaced apart line and column electrodes intersecting but remaining electrically separated from each other through a non-specific resistance layer. The network of matrix points, therefore, is, so to speak, arranged on the outermost periphery of the print and transfer cylinder, and can be activated very easily by applying a voltage to one line and one column electrode; the resistance layer in between is locally heated in the cross-section, and that establishes the possibility of ink transfer; only heated ink will be transferred. The dots of a print line will be activated by concurrently feeding current to one line electrode and to all those column electrodes intersecting that one line and delineating therewith all the matrix points on that line to be printed. The application of a voltage to two juxtaposed line electrodes activates, in fact, a small strip along the drum's periphery to obtain, in fact, horizontally merging dots. Altogether, it is significant for the regenerating process mentioned earlier.

A network of matrix points can be manufactured in an economic fashion on a large scale and, as far as engineering is concerned, with relative ease. Line and column electrodes being electrical conductor strips are fastened to carrier foils and the resistance layer is placed in between. Thus, crossing conductors of line and column electrodes with carrier foils and resistance layers inbetween constitute a single unit. The manufacture of such a thermo transfer printer can be improved further by making line and column electrodes with carrier, possibly together with the interposed resistance layer as a kind of printed circuit configuration which, as a whole, is quite flexible. The flexion is sufficiently high and can establish the network of matrix points quite accurately on the drum and in geometric contour agreement therewith.

The electronics should be arranged inside the drum and slip rings feed clock and data bits, as well as supply current, into the interior of the rotating drum. The carrier foils mentioned above are continued into the interior of the drum for connection to the slip ring connected feed lines.

DESCRIPTION OF THE DRAWINGS

While the specification concludes with claims particularly pointing out and distinctly claiming the subject matter which is regarded as the invention, it is believed that the invention, the objects and features of the invention, and further objects, features and advantages thereof will be better understood from the following description taken in connection with the accompanying drawings, in which:

FIG. 1 is somewhat schematically a side view of and into a cylindrical printed transfer drum with platen, record medium, and inking station;

FIG. 2 is a perspective view on an enlarged scale showing the layer construction by selective peeling away of layers of the cylindrical drum, shown in FIG. 1, the area of enlargement is indicated in FIG. 1 by the circle A;

FIG. 2*a* is a view as indicated by arrow B in FIG. 2, the layers have also been peeled away in parts.

Figure 3:
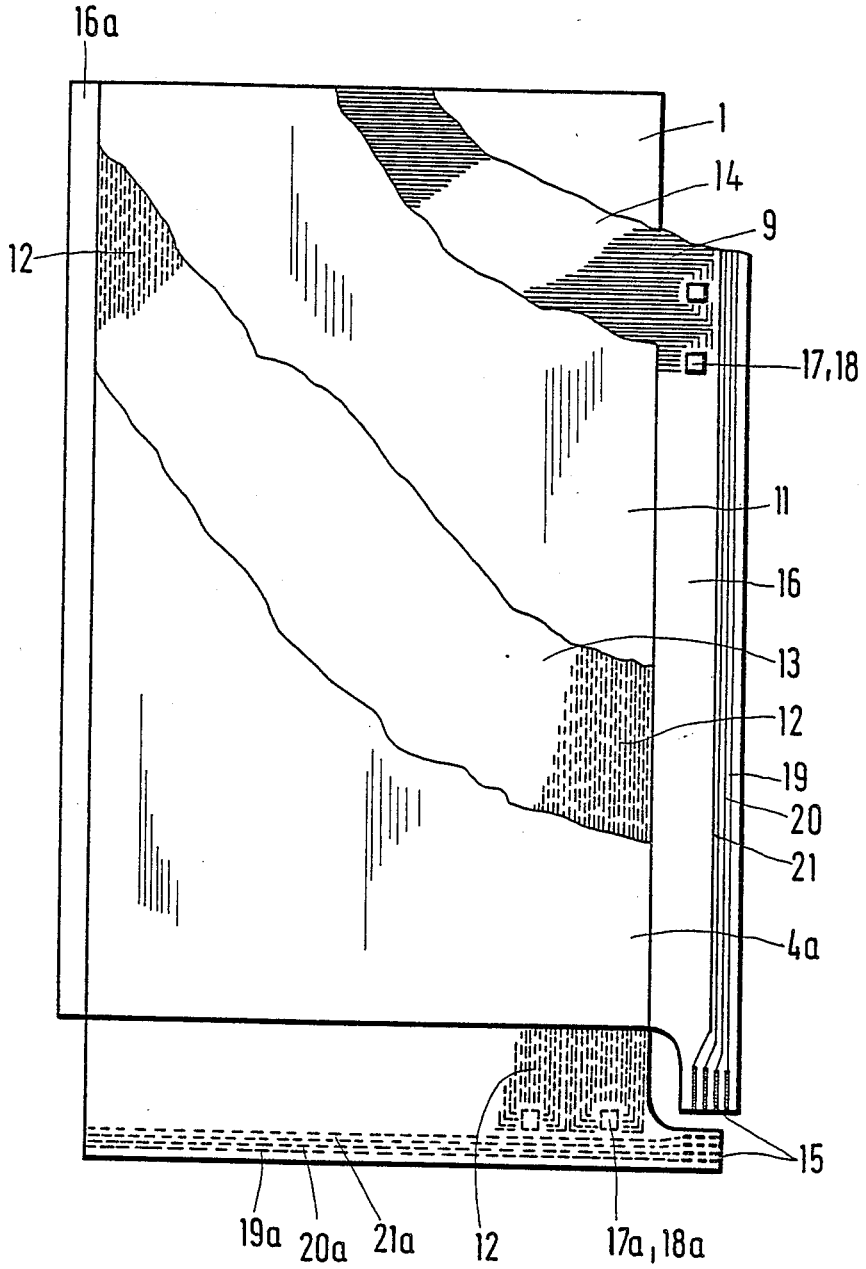
FIG. 3 is a geometric development of a network of matrix dots as it is effective on the cylindrical drum of FIG. 1 showing additionally external electrical connections.

Proceeding now to the detailed description of the drawings, it is pointed out that the principle realized by the equipment to be described in accordance with the invention is based on an association of a cylindrical drum 1 having a carrier member 1*a* with a flat record medium 2 which can be regular paper, being sandwiched along a line 8 of printing between that drum and a platen 3. An ink or dye dispensing station 4 is disposed a little downstream from the printing area 8. The ink or dye becomes activated through heating of selected spots on the drum, and will, in fact, adhere to those spots which have just been depleted from ink by printing on the record carrier 2 which is assumed to be moved on a continuous basis as shown, for example, by the arrow. The device operates by synchronous speed of drum 1, carrier 2, and platen 3*a*.

The platen drum 3 is specifically comprised of an idling cylindrical element 3*a* having an appropriate friction surface to positively engage the record medium 2 from the rear. The active-most element is the cylindrical drum 1. Its periphery includes a network of matrix points 5, details of which are better discernible from FIG. 2*a*. Each matrix dot or point is established by the (hypothetical) intersection of lines 12 and column 9. They do not actually intersect but are resistively (electrically) spaced apart by a layer 11.

The thermally active dye or ink from the station 4 is applied to the drum's periphery only to those matrix points which receive electric current and are heated. These points previously had their dye content depleted for the purposes of forming characters or character points 6 on paper 2. Thus, in the direction of arrow 7 and ahead, i.e. upstream, from the print area 8 (downstream from ink dispenser 4), there is always present a complete, i.e. coherent and contiguous thermo dye layer present. In case of a multi color printing several ink stations with different color ink or dyes are provided. The inks and dyes then preferably having the basic colors.

The network of matrix points 5 is established through column defining electrodes 9 on the periphery, but in the interior of the drum running in azimuthal or peripheral direction transversely to the longitudinal axis 10 of the drum, and being, so to speak, crossed by line defining electrodes 12 which run in parallel to the longitudinal axes 10. The two sets of electrodes 9 and 12 are separated by an intermediate electrically resistance layer 11. The electrodes 9 proper and the electrodes 12 proper are, in fact, embedded in or "printed on" insulating carrier foil material 14 and 13, respectively. The outer layer, so to speak, is only a temporary one, namely established by the thermally active ink 4*a*.

The interior 1*a* of the tube receives the electronics to which the matrix point defining electrodes 9, 12 are connected. The circuit is in parts contained on an extension 16 of foil 14, which is bent off and run through a slot in drum defining tube 1*a* into the interior thereof. The particular connections for serial data bits, current feed and supply, as well as common return path, are run through slip rings 15, indicated only schematically in FIG. 3. The serial feeding of data may, in the alternative, be transferred through a transformer including a rotor and a stator.

As shown also in FIG. 3 the resistive layer 11 is disposed on top of the column defining electrodes 9. The resistance layer 11 carries the carrier foil 13 for the line electrodes 12, which extend parallel to the axis 10 of the drum as stated. Electrodes 9 are on carier foil 14. The line electrodes 12 carry, so to speak, a thin layer of heat meltable thermally active ink 4*a*.

FIG. 3 illustrates more particularly that part of the control electronics mounted strip 16. The control electronic is equipped with an integrated circuit, including driver circuit 17 and shift registers 18. The carrier foil 13 on the cylindrical drum 1 can be seen in FIG. 3 in conjunction with the column defining electrodes 9 there above. The lines 19, 20 and 21 connected to the slip rings 15 are respectively provided for clocking signals, data bits. The clock is a high speed shift clock and current supply or VCC.

Analogously to the column driving, the line electrodes 12 are likewise connected to an integrated circuit with driver circuitry 17*a*, shift registers 18*a*, and there are analogously provided conductors 19*a*, 20*a*, and 21*a*, for the clock signal, the data bits, and the current supply. Herin the data bits may be line enabling signals, and the clock is synchronized with the drum rotation; there are as many pulses per revolution as there are lines 12.

The circuit elements 17*a* are the gated driver stages for groups of axial line electrodes 12 being driven by the shift register 18*a* which, so to speak, functions as a ring counter, having a cycle period equal exactly to one revolution of the drum 1. In principle, it is conceivable that non-specifically the shift register 18*a* actuates these lines 12 one after another in cyclic fashion pursuant to the revolution of the drum 1. Actually, two times actuation per revolution is needed, once just ahead of passage of the respective activated line 12 ahead of print area and line 8, and again just ahead of ink dispenser 4. However, it may be advisable to operate the circuit such that in case on one line 12 not a single matrix point is to be heated, then that particular line 12 will not be turned on. This will be of course, the case in-between two character lines to be printed.

The elements 17 are also driver stages for the column lines 9 and cooperating with shift registers 18, there being of course as many register stages as there are column lines 9 over the entire periphery of the drum. By means of a high speed clock this register 18 will receive data bits spanning a period which is comparable in principle to that period given by a revolution of drum 1 divided by the number of lines 12. Thus, activation of one line 12 may also mark the period loading the register 18 serially. By operation of a gating signal derived from clock line 19*a*, all those driver stages 17, being connected to the stages of register 18 that hold print data bits, will be turned on.

It should be noted that driver stages 17 and 17*a* have opposite direction of conduction as current flows e.g. from a driver 17 through the respective line 9, into one (or several) matrix points, i.e. through a small portion of resistance layer 11, into the intersecting line 12 and out through driver 17*a* for that line 12.

It can thus, be seen that the overall operation is as follows. It may begin by non-specifically heating all matrix points by activating all columns 9, and one line 12 after another, just prior to passing ink dispenser 4. This way, a coherent layer of ink (rapidly drying or solidifying) is formed on the outer periphery of the drum. For purposes of printing, selected dots (matrix points 5) are formed by selectively activating electrodes 12 just ahead of the print line or area 8 and by also activating selected column electrodes 9. The re-heated ink is transferred as dots on contact with paper 2 in area 8. A little later, the same matrix points are heated again to pick up ink when passing dispensing station 4.

The invention is not limited to the embodiments described above, but all changes and modifications thereof, not constituting departures from the spirit and scope of the invention, are intended to be included.

I claim:

1. A thermo transfer matrix printer comprising:

a print drum having over its entire periphery a first set of equidistantly spaced axially extending electrode lines, further having, also over its entire periphery, a second set, of azimuthally extending electrode lines, electrical resistance means, said first and second sets of electrode lines being substantially perpendicular and separated by said electrical resistance means, the electrode lines of the first set crossing the electrode lines of the second set but separated therefrom by said resistance means being resistively interconnected at said crossing points, thereby establishing heatable matrix points;

means disposed along the periphery of said drum for transferring over the entire length of the drum thermo ink and dye to adhere to the outer periphery of the drum at heated ones of said heatable matrix points; and a platen drum disposed adjacent said print drum for urging a print medium against said print drum along a tangential line of printing to transfer said thermo ink from the periphery of said print drum to the print medium.

2. Printer as in claim 1, the lines of the sets being disposed on flexible carrier foils.

3. A method of matrix printing comprising the steps of providing a print drum, providing a first set of equidistantly spaced axially extending electrode lines which extend over the entire periphery of said print drum, providing a second set of azimuthally extending electrode lines also over the entire periphery of said drum, providing electrical resistance means between said first and second sets of electrode lines, the electrode lines of the first set crossing the electrode lines of the second set but separated therefrom by said electrical resistance means to resistively interconnect said lines of said first and second sets at said crossing points to establish heatable matrix points, disposing means along the periphery of said drum for transferring over the entire length of the drum thermo ink and dye to adhere to the outer periphery of the drum at heated ones of said heatable matrix points, energizing an electrode line of said first set and an electrode line of said second set for heating the respective matrix point to obtain an ink dot, positioning a platen roller adjacent said print drum, urging a print medium against said print drum by means of said platen drum along a tangential line of printing, energizing said electrode line of said first set and said electrode line of said second set again to transfer said thermo ink from the periphery of said print drum to the print medium.

* * * * *